US005226868A

United States Patent [19]

Montgomery

[11] Patent Number: 5,226,868

[45] Date of Patent: Jul. 13, 1993

[54] POWER PUSH-UP DEVICE

[76] Inventor: Calvin W. Montgomery, 4 Baynard Cove Rd., Hilton Head Island, S.C. 29928

[21] Appl. No.: 888,489

[22] Filed: May 27, 1992

[51] Int. Cl.[5] ..... A63B 23/02

[52] U.S. Cl. ..... 482/141; 482/37; 482/148

[58] Field of Search ..... 16/114 R, 126, 125, 16/112; 482/142, 37, 141, 148, 130, 35, 36; 248/217.1, 217.2, 216.1

[56] References Cited

U.S. PATENT DOCUMENTS

| | | | |
|---|---|---|---|
| 1,573,362 | 2/1926 | Stovall | 482/148 |
| 2,355,978 | 8/1944 | Keeler | 16/125 |
| 2,666,640 | 1/1954 | Jennings, Sr. . | |
| 2,790,616 | 4/1957 | Cardinal | 248/221.2 |
| 2,817,347 | 12/1957 | Hilt, Sr. | 482/141 |
| 2,974,918 | 3/1961 | Voigtlander | 248/221.2 |
| 3,115,338 | 12/1963 | Acs et al. . | |
| 3,506,261 | 4/1970 | Gregory | 482/37 |
| 3,947,023 | 3/1976 | Martin | 482/142 |
| 4,126,308 | 11/1978 | Crumley | 482/148 |
| 4,232,863 | 11/1980 | Roach . | |
| 4,351,525 | 9/1982 | Rozenblad . | |
| 4,358,106 | 11/1982 | Shadford . | |
| 4,610,448 | 9/1986 | Hill . | |
| 4,854,573 | 8/1989 | Johannson et al. . | |

FOREIGN PATENT DOCUMENTS

| | | | |
|---|---|---|---|
| 70621 | 11/1930 | Sweden | 16/125 |

OTHER PUBLICATIONS

Sunday Magazine, *The Washington Star*, Apr. 23, 1967, "A wall Peg Board" by Lou Chacos.

*Primary Examiner*—Richard J. Apley
*Assistant Examiner*—Jerome Donnelly
*Attorney, Agent, or Firm*—Jacobson, Price, Holman & Stern

[57] ABSTRACT

An exercise device including a push-up board and two push-up handles. The two C-shaped push-up handles are mounted along various positions of the push-up board. Only one end of the C-shaped handles is located within symmetrically-spaced holes of the push-up board. Since only one end of the C-shaped handle is secured within the board and with the shape of the inserted handle end being round, the C-shaped handles are rotatable about the anchored end to provide a vast array of movement and varied exercise routines. A position most comfortable for the user is obtainable by rotation of the handle about the one end located in the push-up board. Numerous pre-set positions are available for doing push-ups to obtain a maximum health benefit from basic push-ups. Further, an adjustment is provided for maximum strength development and wrist comfort when doing difficult push-ups through a series of wide to narrow hand separation positions.

14 Claims, 2 Drawing Sheets 16
18
36
60
62
64
66
68
70
72
74
76
78
80
82
84
86
88
90
92
96
98
99
100
102
7

POWER PUSH-UP DEVICE

FIELD OF THE INVENTION

This invention relates to an exercise device used for performing different types of push-ups to stress and strengthen various muscles.

BACKGROUND OF THE INVENTION

Various attempts have been made to provide varied push-up exercise techniques. Some examples of patents which reflect these attempts are:

U.S. Pat. No. 4,358,106 to Shadford discloses an exercising stand which has an elongated base with an underside adapted to be placed on a supporting surface and the upper side divided into a pair of end areas separated by a central area. The upper side of the base has pegs or stand-offs which are arranged on each end area in a predetermined pattern. A U-shaped hand grip is removably carried on selected pairs of the pegs associated with each end area.

U.S. Pat. No. 4,351,525 to Rozenblad discloses an exercise device having one or two wood plaques with relatively flat, inverted U-shaped bars extending vertically upright on the plaques.

U.S. Pat. No. 4,232,863 to Roach discloses a fitness bar having a base bar that has a pair of support arms extending generally upwardly from the distal ends of the base bar and a pair of support legs extending downwardly from the ends of the transverse beam bars.

U.S. Pat. No. 2,666,640 to Jennings, Sr. discloses a portable combination exercising stand, table and foot or leg rest having a pair of inverted U-shaped frames held in thrust resisting sleeves on the ends of a horizontal thrust resisting bar.

U.S. Pat. No. 3,115,338 to Acs et al. discloses an exercise device consisting of a pair of handles rigidly supported on a base to assist a user in various exercises.

U.S. Patent No. 4,610,448 to Hill discloses a hand grip for push-ups having cylindrical handles mounted on a U-shaped clevis, which is mounted on a base.

U.S. Pat. No. 4,854,573 to Johannson et al. discloses an exercising device having a handle and first and second supports.

The patents to Shadford, Rozenblad, Johannson et al., Hill and Acs et al. are similar in providing handles having both of their ends fixed in position. Some of the devices disclosed in these patents may prove injurious if the handles are separated to such an extent that the handles would tip inwardly during exercise.

The patents to Jennings, Sr. and Roach disclose push-up stands which also are unstable during use.

The present invention avoids many of the drawbacks encountered in the prior known devices.

SUMMARY OF THE INVENTION

By the present invention, numerous pre-set positions are available for doing push-ups to obtain a maximum health benefit from basic push-ups. Further, an adjustment is provided for maximum strength development and wrist comfort when doing difficult push-ups through a series of wide to narrow hand separation positions.

The invention includes a push-up board and two push-up handles. The two C-shaped push-up handles are mounted along various positions of the push-up board. Only one end of the C-shaped handles is located within symmetrically-spaced holes of the push-up board. Since only one end of the C-shaped handle is secured within the board and with the shape of the inserted handle end being round, the C-shaped handles are rotatable about the anchored end to provide a vast array of movement and varied exercise routines. A position most comfortable for the user is obtainable by rotation of the handle about the one end located in the push-up board. It is impossible for the handles to collapse because they fit into an elongated push-up board. Furthermore, it is possible to position the handles very close together to achieve previously impossible push-up positions.

The two C-shaped handles are slightly angled to best fit the wrist during push-ups. A series of symmetrically spaced holes spread across the push-up board in one embodiment, allow exact duplication during workouts of a prior exercise. Isolation of selected muscles for exercise is achieved as was not previously possible. The position of the handles may be subtly or dramatically changed to custom-fit the needs of the exerciser.

In an alternate embodiment of the invention, the handles are slidable along the length of the push-up board so that one end of the handles is anchored in a slot in the board and the opposite end of the handles are movable with respect to the locked-in end of the handle. It is contemplated as being within the scope of the invention that the slotted path along the push-up board may be of a curved or circuitous route such as to provide an infinite number of secure positions for the C-shaped handles.

It is therefore an object of the present invention to provide a power push-up device having a push-up board onto which are pivotally mounted two C-shaped handles having one end fitable into the board and the opposite end having an anti-skid cushion to lock the position of the handles during push-up exercises.

It is another object of the present invention to provide a power push-up device having a push-up board onto which are pivotally mounted two C-shaped handles having one end fitable into the board and the opposite end having an anti-skid cushion to lock the position of the handles during push-up exercises with a plurality of symmetrically spaced holes in the board which serve as the pivot end for the pivotal end of the handles.

It is yet another object of the present invention to provide a power push-up device having a push-up board onto which are pivotally mounted two C-shaped handles having one end fitable into the board and the opposite end having an anti-skid cushion to lock the position of the handles during push-up exercises with a slot in the board for sliding the pivotal end of the handles to achieve symmetrically or asymmetrically spaced placement of the handles so as to provide a customized exercise device.

It is yet another object of the present invention to provide a power push-up device having a push-up board onto which are pivotally mounted two C-shaped handles having one end fitable into the board and the opposite end having an anti-skid cushion to lock the position of the handles during push-up exercises with the handles being pivotable to achieve customized push-up exercise.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
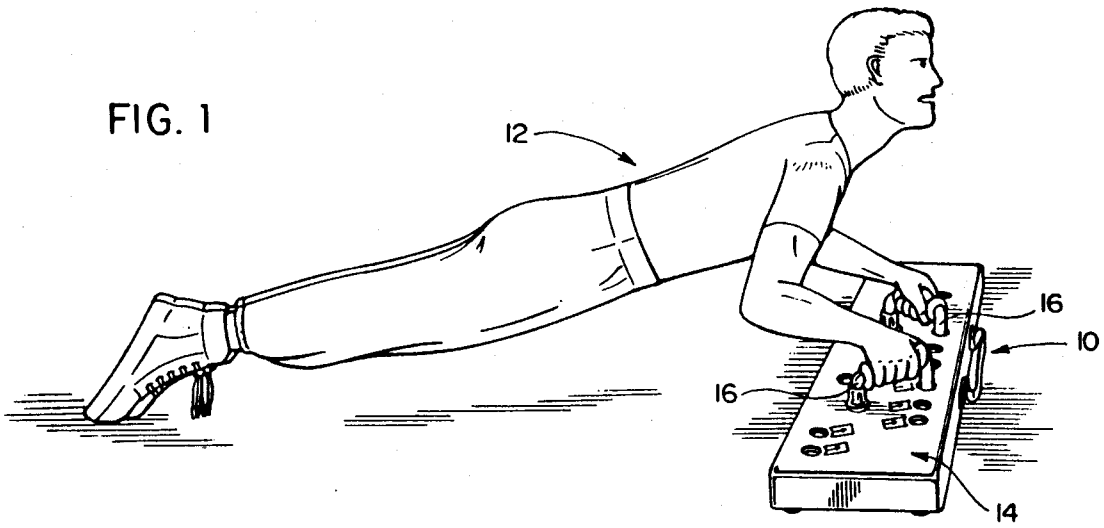
FIG. 1 is a perspective view of the power push-up exercise device in use.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

In a preferred embodiment, with reference to the drawings, in general, and to FIGS. 1 through 4, in particular, a power push-up device embodying the teachings of the subject invention is generally designated as 10. As shown in FIG. 1, an exerciser 12 is taking advantage of the device for a customized push-up exercise routine.

Figure 2:
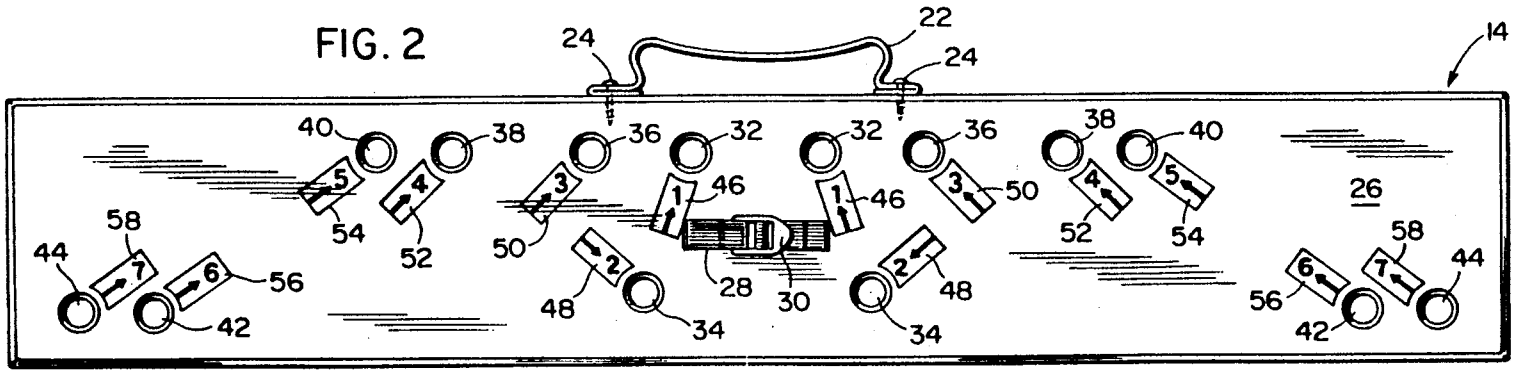
FIG. 2 is a top plan view of the push-up board.
Figure 3:
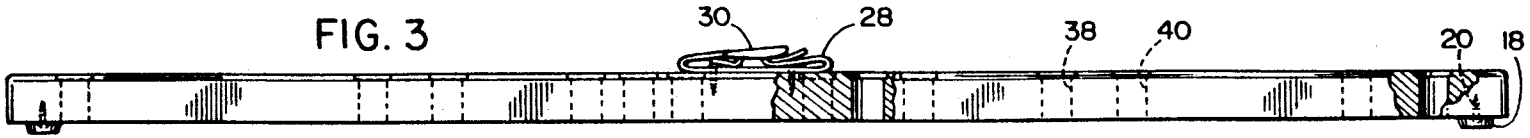
FIG. 3 is a side elevation view of the push-up board.

With reference to its orientation in FIG. 1, the power push-up exercise device comprises a push-up board 14 and two C-shaped handles 16. The board, as shown in FIGS. 2 and 3 is of rectangular configuration, measuring approximately 41 inches long by 7 inches wide and 1½ inches thick. Secured to the underside of the board 14 are four non-skid pads 18 secured by screws 20 into the underside of the board. On one edge of the board is a carrying handle 22 secured to the edge of the board by two screws 24. On the upper face 26 of the board 14 is a strap 28 and buckle 30 arrangement for securing the push-up handles 16 to the board during transit.

In FIG. 2, a plurality of symmetrically spaced hole pairs 32, 34, 36, 38, 40, 42 and 44 are shown. For ease of identification, indicia tag pairs 46, 48, 50, 52, 54, 56 and 58 are positioned adjacent to holes pairs 32 through 44, respectively. The indicia tags are for facilitating quick identification of symmetrically spaced hole pairs 32 through 44. In the embodiment shown in FIG. 2, the hole pairs 32 through 44 are marked as hole pairs 1 through 7, respectively.

Figures 4, 5, 6, 7, 8:
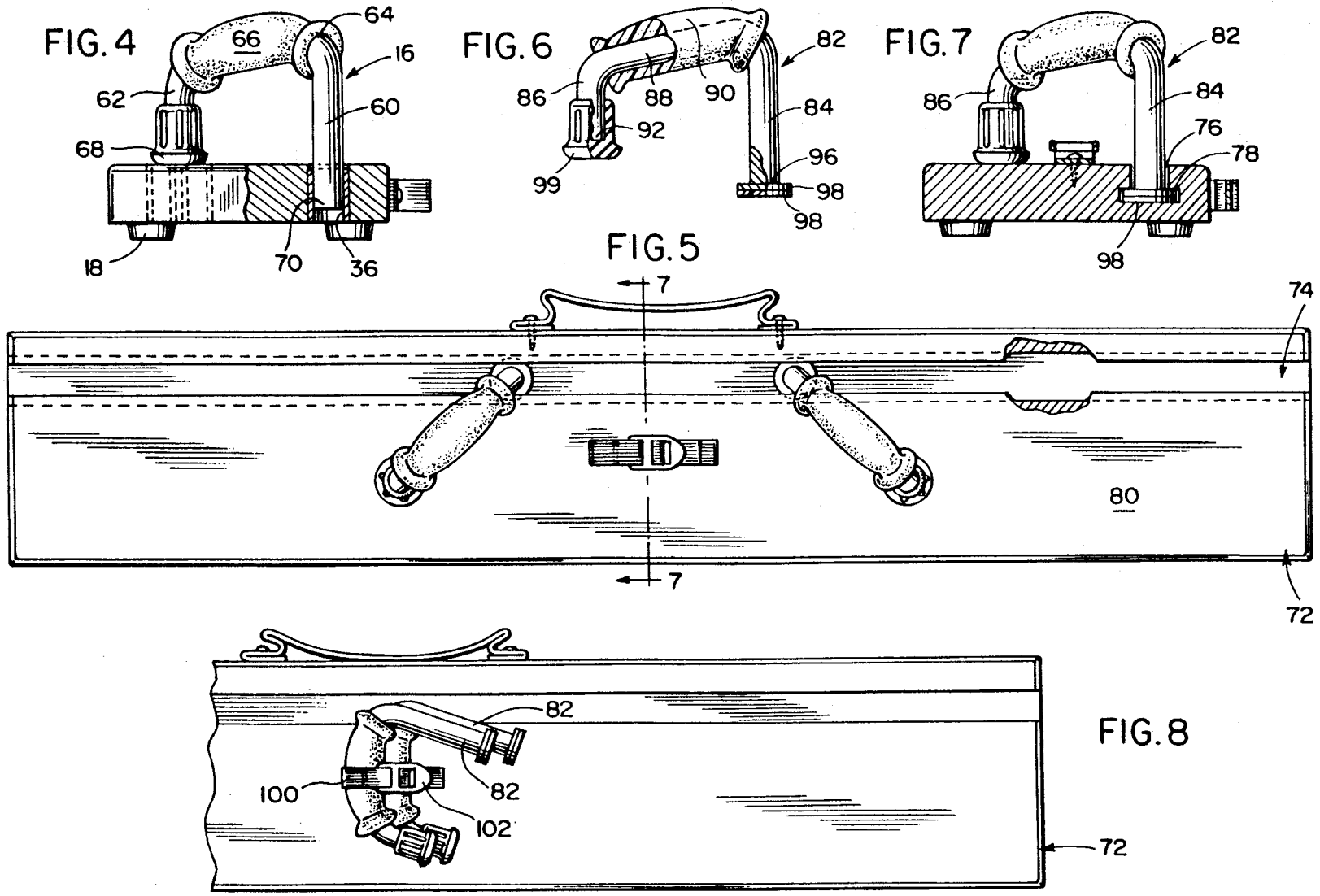
FIG. 4 is a sectional view of a C-shaped handle used in combination with the push-up board show in FIGS. 2 and 3.
FIG. 5 is a top plan partial cut-away view of an alternate embodiment push-up board and C-shaped handles.
FIG. 6 is a side elevation, partial sectional view of the C-shaped handles shown in FIG. 5.
FIG. 7 is a cross-sectional view taken along line 7—7 of FIG. 5.
FIG. 8 illustrates a storage position of the push-up handles.

With reference to FIG. 4, a single push-up handle 16 will be described, it being understood that the other push-up handle is identical. In FIG. 4, the push-up handle 16 is C-shaped having two legs 60 and 62 with a central interconnecting cross-piece 6 which is covered by hand grip 66.

At the free end of leg 62 is a non-skid bumper 68 which contacts the upper surface 26 of the push-up board 14. The length of leg 60 is less than that of leg 62 so that when the free end 70 of leg 60 fits within a hole, for example, hole 36 of push-up board 14, bumper 68 contacts the upper surface 26 of board 14. In addition to leg 60 being longer than leg 62, leg 60 rises above the height of leg 62 so that cross-piece 64 extends at a downward angle from leg 60 to leg 62. This provides comfort for the exerciser during their exercise routine. Push-up handle 16 is formed of a metal tube having a diameter substantially equal to the size of hole pairs 32 through 44 but being of a slightly lesser diameter so that the free end 70 of leg 60 of the push-up handle 16 is rotatably mounted within the hole 36, for example.

During exercise, a pair of any one of hole pairs 36 through 44 is selected by the exerciser 12. The free end 70 of the push-u handles 16 is positioned within the hole pairs. The leg 62 of the push-up handle is then varied in position to any radial position from the hole on the upper surface 26 of the push-up board 14, to a position most comfortable for the exerciser. It is not required that the push-up handles be aligned at identical angles with respect to the central transverse axis of the push-up board 14, but to a position most comfortable to the exerciser.

An exercise routine may include placement of the push-up handles in any of the identified pairs of holes 32 through 44 of the board 14 or, if desired, in any two holes of the board 14. The possibilities of positioning of the push-up handles is thereby infinite according to the comfort and needs of the exerciser (in a preferred embodiment).

In an alternate embodiment, as shown in FIG. 5 through 7, a push-up board 72 includes an elongated slot 74, in the example shown, extending along the length of the board 72. The slot 74, as shown in cross-section in FIG. 7, includes an upper channel 76 opening to the upper surface 80 of the board 72 and having a lower channel portion 78 defining the lowermost portion of the slot 74. The lower channel 78 is wider than the upper channel 76 for locking in position the push-handles, as will be explained with reference to FIGS. 6 and 7.

In FIG. 6, a push-up handle 82 is shown as having two legs 84 and 86 and connecting cross-piece 88. Surrounding crosspiece 88 is hand-grid 90. A lower portion 92 of leg 86 includes a non-skid bumper 94. A free end 96 of leg 84 includes two discs 98 secured thereto. The discs are of a width wider than the diameter of the bar forming the push-up handle 82. As with the push-up handle 16, the legs 84, 86 are of different lengths so that the cross-piece 88 is inclined at an angle between the upper ends of each of the legs 84 and 86.

With reference to FIG. 7, the handle 82 is positioned on the board 72 by sliding of the end 96 of the handle into the slot 74 from one end of the board 72. The width and height of the discs 98 are comparable to that of the lower channel 78 but provide a slight spacing between the side walls of the channel 78 and the discs 98 so that the free end 96 of the handle 82 is slidable within the groove 74. The width of the channel 78 is greater than the width of the channel 76 to prevent an upper movement of the handle 82 out of the groove 74.

As described with reference to FIGS. 1 through 4, when the legs 84 of the handles 82 are in position, it is possible to pivot the handles 82 about the leg 84 of the handles so as to vary the positioning of the leg 86 of the handles to a desired position for exercise by the user. In FIG. 5, the pivoted positions of the handles 82 are shown for exercising by the user.

As with handle 16, handles 82 are removable from the board 72, with handles 82 being slidable out of the groove 74 and securable to the board 72 by a strap 100 and buckle 102 during movement of the exercise device.

By the present invention, a customized exercise routine is established by the random orientation of push-up handles with respect to a push-up board to maximum exercise efforts for improved health and muscle development. This device is easily transportable and may be quickly set up for use in the home, office, health club or anywhere desired.

Having described the invention, many modifications thereto will become apparent to those skilled in the art to which it pertains without deviation from the spirit of the invention as defined by the scope of the appended claims.

I claim:

1. A portatable exercising device adapted for use in performing various push-up type manuevers, said portable exercising device comprising:

an elongated push-up board, said push-up board including a plurality of holes positioned in a predetermined scattered arrangement within said board, and at least two handles, said handles being formed substantially in a C-shaped configuration having two legs and a cross-piece connecting said legs and being large enough to allow a users hand to encircle said cross piece, one of said two legs being longer than the other leg so as to allow said longer leg to be rotatably positioned in one of said plurality of holes, thus allowing said other leg to be movable about said push-up board in an arc of rotation about said longer leg of each handle.

2. An exercise device according to claim 1, wherein said cross-piece is inclined at an angle to said board when said handles are mounted on said board.

3. An exercise device according to claim 1, wherein a free end of said other legs of said handles are fixed in position on an upper surface of said board during exercise when said one of said legs of said handles are in said holes.

4. An exercise device according to claim 3, wherein said free end of said other legs of said handles include skid means for preventing sliding of said free end of said other legs across said board during exercise.

5. An exercise device according to claim 1, wherein said board includes a carrying strap.

6. An exercise device according to claim 1, wherein said holes are formed as symmetrical hole pairs.

7. A portable exercising device adapted for use in performing various push-up type manuevers, said portable exercising device comprising:

an elongated push-up board, said push-up board including elongated slot means positioned on an upper surface of said push-up board for receipt of a push-up handle, and at least two handles, said handles being formed substantially in a C-shaped configuration having two legs and a cross-piece connecting said legs and being large enough to allow a users hand to encircle said cross piece; one of said two legs being longer than the other leg so as to allow said longer leg to be rotatably positioned within said elongated slot means, thus allowing said other leg to be movable about said push-up board in an arc of rotation about said longer leg of each handle.

8. An exercise device according to claim 7, wherein said cross-piece is inclined at an angle to said board when said handles are mounted on said board.

9. An exercise device according to claim 7, wherein a free end of said other legs of said handles are fixed in position on an upper surface of said board during exercise when said one of said legs of said handles are in said holes.

10. An exercise device according to claim 9, wherein said free end of said other legs of said handles include skid means for preventing sliding of said free end of said other legs across said board during exercise.

11. An exercise device according to claim 7, wherein said slot includes an upper channel and a lower channel, said lower channel being wider than said upper channel.

12. A portable exercising device adapted for use in performing various push-up type manuevers, said portable exercising device comprising:

an elongated push-up board, said push-up board including a plurality of hole pairs being formed symmetrically on opposite sides of a central transverse axis of said board in a predetermined scattered arrangement within said board and at least a pair of handles, said pair of handles each being formed substantially in a C-shaped configuration having two legs and a cross piece connecting said legs and being large enough to allow a users hand to encircle said cross piece, one of said two legs of each handle being longer than the other leg so as to allow said longer leg to be rotatably positioned in one of said plurality of hole pairs, thus allowing said other leg to be movable about said push-up board in an arc of rotation about said longer leg of each handle and said other of said two legs having skid means for preventing sliding on said board.

13. An exercise device according to claim 12, wherein said cross-piece is inclined at an angle to said board when said handles are mounted on said board.

14. An exercise device according to claim 12, wherein said board includes a carrying strap.

* * * * *